US011236473B2

(12) United States Patent
Braun

(10) Patent No.: US 11,236,473 B2
(45) Date of Patent: Feb. 1, 2022

(54) TRANSITION CONSTRUCTION FOR BRIDGING A BUILDING JOINT

(71) Applicant: Maurer Engineering GmbH, Munich (DE)

(72) Inventor: Christian Braun, Holzkirchen (DE)

(73) Assignee: MAURER ENGINEERING GMBH, Munich (DE)

( * ) Notice: Subject to any disclaimer, the term of this patent is extended or adjusted under 35 U.S.C. 154(b) by 167 days.

(21) Appl. No.: 16/083,963

(22) PCT Filed: Mar. 29, 2017

(86) PCT No.: PCT/EP2017/057461
§ 371 (c)(1),
(2) Date: Sep. 11, 2018

(87) PCT Pub. No.: WO2017/167830
PCT Pub. Date: Oct. 5, 2017

(65) Prior Publication Data

US 2020/0157752 A1 May 21, 2020

(30) Foreign Application Priority Data

Mar. 29, 2016 (DE) ..... 10 2016 205 081.8

(51) Int. Cl.

| | |
|---|---|
| ***E01C 11/00*** | (2006.01) |
| ***E01D 19/06*** | (2006.01) |
| ***E01C 11/08*** | (2006.01) |
| ***E04B 1/68*** | (2006.01) |

(52) U.S. Cl.
CPC ..... *E01D 19/065* (2013.01); *E01C 11/08* (2013.01); *E04B 1/6804* (2013.01)

(58) Field of Classification Search
CPC ..... E01D 19/065; E01C 11/08; E04B 1/6804
USPC ..... 404/34–72; 14/73–73.5, 77.1, 78
See application file for complete search history.

(56) References Cited

U.S. PATENT DOCUMENTS 2,013,195 A * 9/1935 Ward ..... E01D 19/065 14/73.1
2,286,019 A * 6/1942 Smith ..... E01D 19/065 404/47
3,273,473 A * 9/1966 Pare ..... E01D 19/06 404/49
4,063,840 A * 12/1977 Fordyce ..... E01D 19/06 404/69

(Continued)

FOREIGN PATENT DOCUMENTS

AT 413 989 B 8/2006
CH 360 411 A 2/1962

(Continued)

OTHER PUBLICATIONS

An Examiner's Requisition issued in Canadian Application No. 3,017,425 dated May 20, 2021.

(Continued)

*Primary Examiner* — Raymond W Addie
(74) *Attorney, Agent, or Firm* — BakerHostetler

(57) ABSTRACT

A transition construction for bridging a building joint between two component parts of a building with at least one cover element that at least partially covers the building joint. The cover element is attached to a component part of the building via an anchoring structure, wherein the anchoring structure is configured such that the at least one cover element is selectively supported.

23 Claims, 2 Drawing Sheets

(56) References Cited

U.S. PATENT DOCUMENTS

| | | | | | |
|---|---|---|---|---|---|
| 4,111,583 | A * | 9/1978 | Brady | E01D 19/06 | 14/73.1 |
| 4,307,974 | A * | 12/1981 | George | E01D 19/06 | 14/73.1 |
| 4,397,579 | A * | 8/1983 | Goldman | E01D 19/06 | 14/73.1 |
| 4,876,759 | A * | 10/1989 | Yang | E01D 19/06 | 14/73.1 |
| 5,584,152 | A * | 12/1996 | Baerveldt | B29D 99/0053 | 52/396.05 |
| 5,966,876 | A | 10/1999 | Neathery et al. | | |
| 8,967,904 | B1 * | 3/2015 | Bub | A61H 3/066 | 404/19 |
| 2002/0138925 | A1 * | 10/2002 | Chang | E01D 19/06 | 14/73.1 |
| 2007/0044257 | A1 * | 3/2007 | Xu | E01D 19/06 | 14/73.1 |
| 2008/0196183 | A1 * | 8/2008 | Xu | E01D 19/06 | 14/73.1 |
| 2010/0263312 | A1 * | 10/2010 | Bradford | E01D 19/065 | 52/309.17 |

FOREIGN PATENT DOCUMENTS

| | | | |
|---|---|---|---|
| DE | 12 31 740 | B | 1/1967 |
| DE | 2344225 | A1 | 3/1975 |
| EP | 1 469 128 | A1 | 10/2004 |
| JP | S53-145330 | A | 12/1978 |
| JP | S57-187803 | U | 11/1982 |
| JP | S63-156103 | A | 6/1988 |
| JP | 7-54305 | A | 2/1995 |
| JP | 11-124801 | A | 5/1999 |
| JP | 2002-309507 | A | 10/2002 |
| JP | 2004-143845 | A | 5/2004 |
| JP | 2011-17243 | A | 1/2011 |
| JP | 2011-74742 | A | 4/2011 |
| JP | 2011-163079 | A | 8/2011 |
| JP | 3174898 | U | 4/2012 |
| WO | 2011/079487 | A1 | 7/2011 |

OTHER PUBLICATIONS

Notice of Reasons for Refusal issued in Japanese Patent Application No. 2018-551854, dated Jan. 6, 2021, with English translation.

* cited by examiner

TRANSITION CONSTRUCTION FOR BRIDGING A BUILDING JOINT

CROSS-REFERENCE TO RELATED APPLICATIONS

This application is a National Stage of International patent application PCT/EP2017/057461, filed on Mar. 29, 2017, which claims priority to foreign German patent application No. 10 2016 205 081.8, filed on Mar. 29, 2016, the disclosures of which are incorporated by reference in their entirety.

FIELD OF THE INVENTION

The present invention relates to a transition construction for bridging a building joint between two component parts of a building with at least one cover element that at least partially covers the building joint and can be attached to a component part of the building via an anchoring structure.

BACKGROUND

Such transition constructions are known in various embodiments. What they all have in common is that they serve for a safe crossing of a building joint by traffic, for example in the form of individuals, animals, vehicles, loads, and the like. Here, a particularly usual field of application is the bridge engineering. However, for the object of the invention all other buildings having building joints are also relevant.

A problem with bridging building joints is that building joints generally change in size and joint width, respectively. This might be for various reasons. For example, because the building or only a component part thereof moves, changes in size, or many more. For example, changes in size can result from temperature fluctuations. Movements can result from a horizontal load application, e.g. by braking vehicles.

Especially in areas such as a carriageway or a sidewalk already smaller unsecured building joints pose a security risk. With the help of the transition construction it can be ensured that the traffic can cross the building joint without any problems, even if the building joint temporarily changes in its spread or joint width.

A known form of such a generic transition construction is the so-called finger joint. This has at least two opposite arranged cover elements that in turn have a number of adjacent fingers. This results in two comb-like fingerplates. These are configured or arranged such that the opposite fingerplates mesh. Depending on how the building joint changes the fingers can be pushed into or apart from each other.

Here, the cover elements each are attached to the component parts of the building that adjoin the building joint by means of anchoring structures. That is, the anchoring structure serves for attaching at least one cover element to the respective component part and accordingly, can be configured in a number of different ways. Thus, the anchoring structure may be made as one part or multiple parts. So, it may be mounting flanges that are welded on a component part made of steel and to which the cover element can be attached. Also, it may only be a screwed connection with which a cover element is attached to the respective component part of the building. However, especially with component parts made of concrete such an anchoring structure is an independent structure of a plurality of components, such as for example anchor brackets, plates, stay bridges, and the like that at least partially are concreted into the component part.

A known solution for anchoring the cover elements is screwing the respective cover element either directly through the building or on an underlying anchoring structure. In these known solutions, the cover element(s) lie flat on the component part of the building or the interposed anchoring structure.

Basically, these known solutions have proven to be reliable. However, it was also shown that it is required to regularly check the screws holding the cover elements. Because, again and again in the past some screws have come loose or damages have been generated by corrosion. If the maintenance intervals are not met this can lead to the fact that corroding or loosing screws are not detected in good time. This results in loose cover elements that clatter when loaded and in the worst come loose.

SUMMARY OF THE INVENTION

Thus, the invention is based on the problem to improve the generic transition construction such that it can be maintained with less effort.

The problem is solved with a transition construction according to claim 1. Suitable developments of the invention are given in the dependent claims.

That is, the transition construction according to the invention is characterized in that the anchoring structure is configured such that the at least one cover element is selectively supported thereon. That is, the so far used flat support is specifically avoided and ideally completely replaced by a selective support. The selective support of the cover element causes that a power flows into the building in a more controlled manner than so far. Thus, attachment of the cover elements can be determined more exactly than so far and tightening force losses due to unevenness, relaxation, and creep can be avoided. This reduces the risk of over or under-sizing the anchor of the cover element.

A further advantage is that by selectively supporting the cover element significantly less moisture can accumulate between the anchoring structure or between a component part and the cover element. This reduces the risk of corrosion. Moreover, it is easier to place a corrosion protection and the draining of the building will be improved overall.

All this results in the fact that less effort has to be invested in the maintenance of the transition construction than so far. Moreover, the transition construction is significantly more durable.

The selective support can be in various ways. For example, it is conceivable to respectively configure the cover element itself, the component part below, or to configure the anchoring structure. However, preferably the selective support is generated by correspondingly configuring the anchoring structure (e.g. by means of corresponding elevations). Then, this provides for the fact that the cover element only selectively contacts the building. In this way, it is formed a well-defined or in other words planned support. This results in a significantly more durable solution than in the prior art.

Here, selective support is meant to be a support in which only a part of the base area of the cover element comes into contact with the component part or the anchoring structure. This part should be smaller than half of the base area of the cover element.

Here it is of advantage for the anchoring structure to have a plurality of support points at least one of which can be adapted and/or oriented in its position independently from the others. Because at least one support point is independent from the others, tolerances and irregularities can virtually perfectly be compensated. At best, the individual support points all can be adapted with respect to their position, so that adjacent support points are not affected.

In a further development the at least one cover element is detachably attached to the anchoring structure by means of at least one screwed connection and the anchoring structure is configured such that at least one screwed connection has a grip length corresponding to at least three times the thickness of the cover element in the region of the respective screwed connection. Here, the screwed connection is preferably tightened from below. By means of the detachable screwed connection between the cover element and the anchoring structure quick demounting of the cover element or its replacement can be enabled in case of maintenance work. Moreover, if the cover element is loosened it is possible to fix it again by tightening the screwed connection. Because the cover element is not directly screwed within the component part, but is attached by means of a correspondingly configured anchoring structure it is moreover possible to avoid a loss of tightening force of the screwed connection within the building by changing the material of the component part, such as for example creep and/or shrinkage of a component part made of concrete.

Here, the screwed connection can be configured in any form in which a thread is used. In this context, studies of the applicant have shown that by means of the correspondingly sized grip length a durable initial tension can be applied more reliably with the relevant stresses than so far. In comparison with the known anchoring structures, significantly greater grip lengths evolve than so far. In general, the selectively significantly increased grip length causes an increase in screw expansion and thus, a decrease in proportional tightening force loss.

Here, the grip length is generally meant to be the thickness of the elements to be connected. This is partially calculated with or without an optionally used washer. However, here it shall be geared to the definition of grip length as is regulated in the version of the standard DIN EN 14399-4 that is valid on the filing date. This prescribes the grip length taking into account the thickness of an optional washer.

Here, the thickness of the cover element is meant to be the distance between the contact surface of the screwed connection on the upper surface of the cover element and the contact surface of the cover element on the anchoring structure in the region of the screw. Thus, recesses in the cover element in the region of the screwed connection are not taken into account.

Preferably, a sealing is arranged on the screwed connection in the region of the cover element to prevent water from penetrating the building in this region. Also, by the sealing loosening of the screwed connection additionally can be prevented.

Suitably, at least one screwed connection has a threaded bolt and at least one tightening means. Here, the threaded bolt can be configured such that it has a bolt head on at least one of its ends. Also, the thread can be continuous or in sections. So, here also solutions shall be included in which a threaded bolt fixes the cover element to the anchoring structure on both ends each by means of at least one nut.

Further, it is of advantage that the threaded bolt is part of a rule-consistent screw. Thus, the screwed connection can reliably be dimensioned with the help of existing rules. In this way, already in planning a corresponding over or under-sizing of the attachment can be prevented.

Advantageously, at least one tightening means is configured as a nut, a bolt head, and/or a thread on the anchoring structure or the cover element. Thus, position and type of a tightening means is not limited to one variant, but can respectively contact and/or be formed both on the cover element and the anchoring structure.

Suitably, the anchoring structure has a tightening means abutting piece for a tightening means formed as a nut or a bolt head on a side facing away from the cover element. In order to achieve a specific tightening force in the screwed connection the respective nut or bolt head requires an abutting piece as an abutment. In this way, occurring forces can be absorbed and a specific tightening force can be achieved.

Further, it is of advantage for the anchoring structure to have a spacer that ensures a defined distance between the cover element and the tightening means abutting piece. By means of the spacer it is also possible to selectively change the grip length of the screwed connection. Moreover, the tightening means abutting piece does not have to be formed from the cover element up to the final contact surface of the tightening means. Preferably, the spacer is made of a material, e.g. a metal, that ensures the distance between the cover plate and the tightening means abutting piece also in case of a large action of forces.

Suitably, the spacer is configured tubular, preferably as a square tube. Tubular in that sense does not only mean a circular cross section, but also a polygonal tube, for example of a quadrangular or hexagonal cross section. Due to the tubular constitution it is possible that a part of the screwed connection can extend within the spacer. Thus, the screwed connection is protected from external influences, such as for example moisture.

Optionally, the anchoring structure can be configured such that it is directly attached to a reinforcement of a component part of the building. Then, the anchoring structure is directly connected to the parts of the building that can absorb large tensile forces and/or compressive forces. The corresponding attachment can be for example by means of screwing or welding.

Suitably, the anchoring structure has at least one anchor device for anchoring within a component part. Preferably, the anchor device is configured as a set bolt. Especially the latter causes a good denticulation of the anchoring structure with the adjacent concrete. So, the cover element can even more securely be attached to the building. Here, the anchor device can directly follow on the spacer or also be a part thereof. By arranging a plurality of anchor devices that preferably extend radially in different directions on several planes the anchoring structure can be fixed to the building even better. In addition to set bolts other configurations are also possible, such as for example disks surrounding the spacer. However, it is preferable to use rule-consistent anchoring aids, such as the above-described set bolts.

It is of further advantage if the transition construction has at least one access duct for a screwed connection, wherein the access duct extends from the anchoring structure to one end of the building. The access duct ensures access to the screwed connection from the respective side of the building where the duct ends. Preferably, the access duct extends from the lower end of the building up to the tightening means abutting piece. So, it is possible to maintain and adjust the screwed connection from below also in the installed state. This is of advantage in that during maintenance work it is not necessary to block the respective circulation area on the upper surface of the cover element. Preferably, the access duct is formed by means of a formwork tube concreted in the component part of the building. In addition to a circular configuration of the duct it is also possible to configure it correspondingly polygonal.

Suitably, a spacer and a tightening means abutting piece as a whole form a retaining anchor. Such a retaining anchor may also have the already mentioned anchor devices to better denticulate the component part in the concrete. Such retaining anchors are easy to prefabricate in large quantities and can be built in as an assembly in the respective buildings.

Preferably, the anchoring structure has a plurality of retaining anchors arranged spaced apart from each other and the selective support of the cover element is realized such that the cover element in the region of the upper front faces of the retaining anchors rests on the anchoring structure. This is of advantage in that the selective support can easily be ensured by means of the retaining anchors. So, the retaining anchors can simply be concreted into the component part such that they slightly protrude beyond the upper surface of the concrete of the respective component part.

Here, the front faces of the retaining anchors form the faces that face the resting cover element and are in contact therewith. Because of only resting on the front faces of the retaining anchors it can also be guaranteed that no other load removal of the cover elements into the building comes about than via the retaining anchor.

Suitably, the anchoring structure has at least one row of retaining anchors in parallel to the building joint and preferably a further row of retaining anchors behind it also in parallel to the building joint. The arrangement in rows simplifies the manufacture. Moreover, by means of the second row of retaining anchors the cover element is additionally fixed and thus, occurring moments by eccentric load are removed as a couple of forces in a defined manner.

In a further development, the transition construction has a draining element that is arranged on the anchoring structure under and spaced apart from the cover element, preferably at an acute angle to the cover element and downward towards the building joint. So, water getting under the cover element can be drained towards the building joint. Moreover, the acute angle ensures that the water runs off well and no large amounts of water accumulate in this region of the building that would promote corrosion. Arranging the draining element on the anchoring structure is of advantage in that the element can provide the necessary support against the water pressing down. Preferably, the draining element is configured flat to protect the greatest possible region of the building under the cover element from penetrating water.

It is of further advantage for the draining element to be configured as a metal sheet that is chamfered downwards at its side facing the building joint such that this side forms a drip edge. This makes it possible to specifically drain off the water toward the building joint. Here, the metal sheet can be made of aluminum, steel, or similar materials, for example. Also, the metal sheet can be coated with a further layer that additionally protects from moisture or also enables better draining off of the moisture toward the building joint.

It is of further advantage for the draining element that is configured as a metal sheet to be chamfered upwards at its side facing away from the building joint and preferably to contact a front face of the cover element. This is of advantage in that water penetrating between the upper edge of the draining element and the building joint is only drained off in one direction, namely toward the building joint. Here, the chamfer can be configured upward in any way. This makes it possible to lead it vertically upward or also configure it oblique or with any profile. Here, the front face of the cover element is meant to be the horizontal end of the cover element on the side spaced apart from the building joint.

Advantageously, the draining element is flexibly attached to the anchoring structure. This is of advantage in that the draining element can easily be attached to the anchoring structure, namely such that it does not contribute to force removal. That is, it is not possible that there is an inadvertent, flat load application of forces from the at least one cover element via the draining into the building.

Alternatively, it is of advantage for the draining element to be flexibly supported on the building. In this way, it can be refrained from attaching the draining element to the anchoring structure. So, it is also made sure that there is no inadvertent force removal into the underlying component part of the building.

It is of further advantage if at least one retaining anchor of the anchoring structure passes through the draining element and in this region a flexible, waterproof seal is arranged. So, the flat draining element can surround the at least one retaining anchor to thus achieve a comprehensive protection from penetrating water. For example, the flexible, waterproof seal can be a silicone seal or a rubber ring. The seal prevents drained off water from penetrating the building in the region of the retaining anchor further downward.

Suitably, the transition construction has a sealing underneath the cover element, especially an elastomeric band. This is of advantage in that a second moisture barrier additionally ensures that no water gets into the underlying region of the anchoring structure and/or the building. Preferably, the sealing is configured comprehensive. For that, water impermeable mats, bands, or metal sheets can be used, for example.

Preferably, the at least one cover element is configured as a fingerplate. This has proofed to be specifically suitable.

In a further development, the transition construction has two anchoring structures that are opposite with respect to the building joint it has to bridge and that have opposite cover elements, wherein the cover elements are preferably configured as meshing fingerplates. This arrangement makes it possible to split up load removal to the two opposite component parts of the building. In addition, thus small to medium-sized building joints can be bridged safely.

It is of further advantage for the transition construction to be modular and to have a plurality of adjacent cover elements and/or draining elements that each are narrower than a carriageway of a car, wherein preferably at least between adjacent draining elements a seal is arranged. Alternatively, the elements can also be welded tightly together. With such a modular configuration transition constructions of slightly different widths can be made by means of standard modules. The additional seal between the adjacent draining elements under the cover element ensures that also in this region no water can penetrate the underlying region of the anchoring structure and/or of the building. Here, the module width of the cover element along the building joint does not necessarily have to correspond to the module width of the draining element.

Preferably, the transition construction is configured as an assembly preassembled in the manufacturing facility in which the at least one cover element is detachably attached to at least one anchoring structure by means of at least one screwed connection. Moreover, the assembly as a whole can be attached to, especially concreted into the component part, preferably with the aid of a transport and/or mounting device via the anchoring structure. This is of advantage in that said transition construction can cost-effectively and efficiently be manufactured in the manufacturing facility and especially, also the screwed connection can be manufactured under defined conditions. On location, the transition construction only has to be attached to the component part via the anchoring structure. Thus, the transition construction can quickly be built in.

BRIEF DESCRIPTION OF THE DRAWINGS

In the following the object of the invention is described in detail with the help of an example. Here.

DETAILED DESCRIPTION

Figure 1:
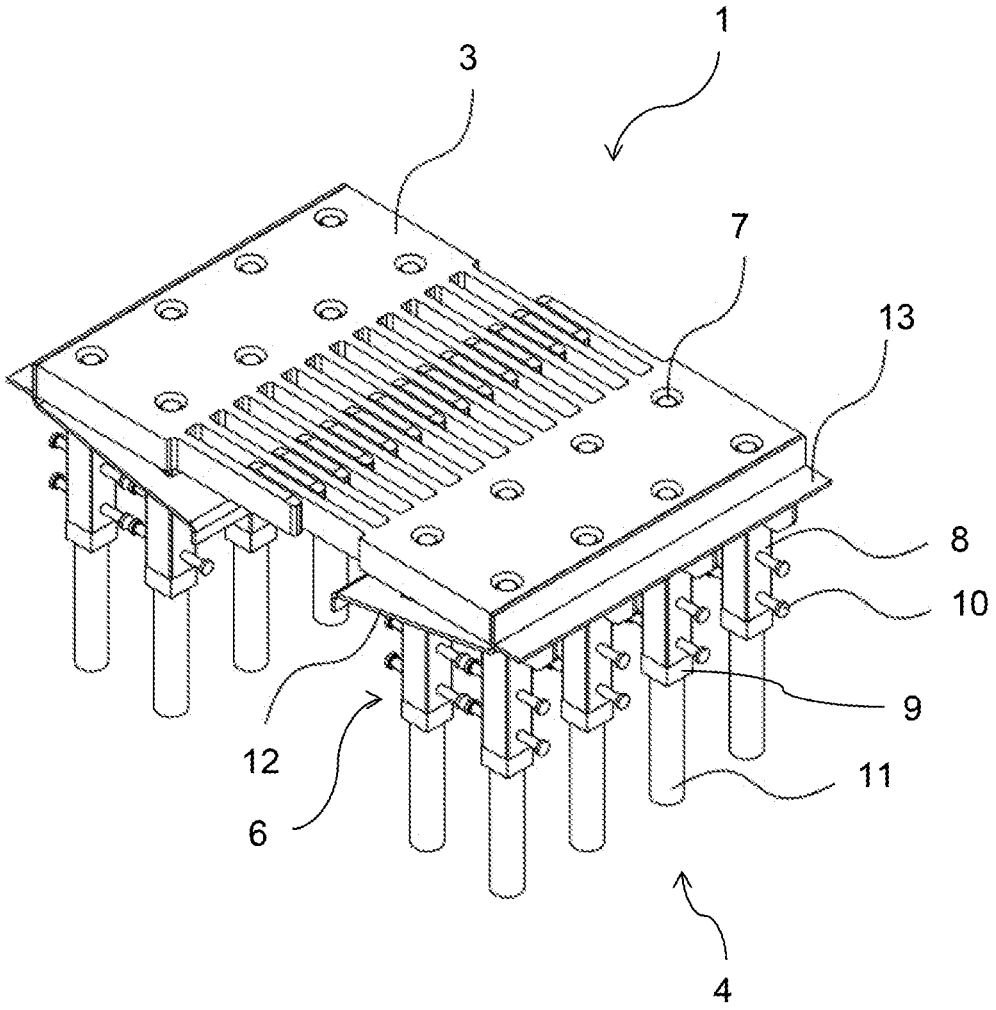
FIG. 1 shows a perspective view of the transition construction according to the invention.

In the present embodiment the transition construction 1 has two cover elements 3 configured as fingerplates that oppositely mesh with the projecting portions. In this way, a building joint between two component parts of the building 2 is bridged. Here, the cover elements 3 each are selectively attached via a concreted anchoring structure 4 to a component part of the building 2 each and adjoin a carriageway 5 with the front face spaced apart from the building joint.

As FIG. 1 shows, the anchoring structure 4 consists of a cover element 3 of two rows of several retaining anchors 6 each in parallel to the building joint. Here, the cover element 3 is detachably attached to the retaining anchors 6 of the anchoring structure 4 with a screwed connection 7 each. In this way, the cover element 3 is selectively supported by the anchoring structure 4 and does not flatly rest on the building 2. In addition, a corbel 14 is arranged between a retaining anchor 6 of the row near the carriageway and the carriageway 5 each. Here, the carriageway 5 does not directly rest on the corbels 14, but on an insulation flange 13 that is arranged between the corbels 14 and the carriageway 5 along the cover element 3.

In this embodiment the screwed connection 7 consists of a threaded bolt 7*a* having a bolt head in the form of a rule-consistent screw that contacts the upper surface of the cover element 3 in a recess. A nut is mounted to the threaded bolt 7*a* as an associated tightening means 7*b* at the distant side of the cover element 3. In this context, the retaining anchor 6 has a spacer 8 as an oblong square tube and a tightening means abutting piece 9, which the tightening means 7*b* does contact. Here, the spacer 8 is arranged between the cover element 3 and the tightening means abutting piece 9 and thus, determines the grip length of the associated screwed connection 7. The threaded bolt 7*a* passes through the spacer 8 and the tightening means abutting piece 9 to come into contact with the tightening means 7*b*.

Figure 2:
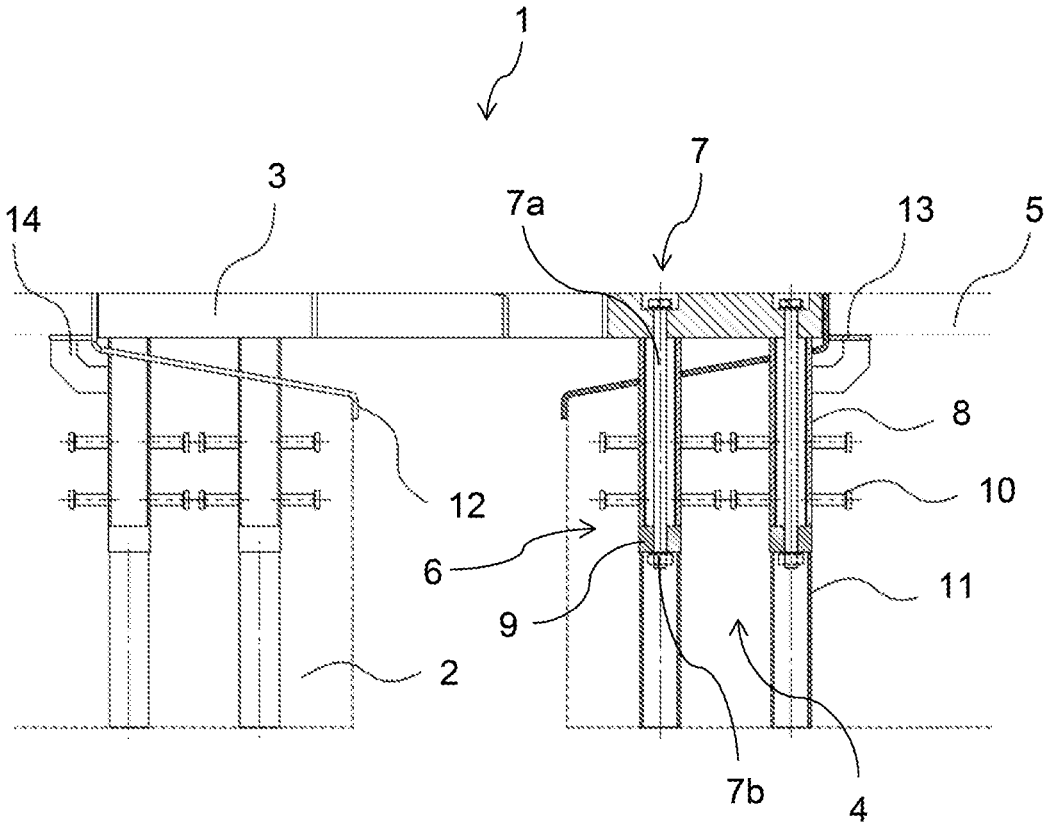
FIG. 2 shows a side elevational view of the transition construction shown in FIG. 1 in the built-in state, wherein the right part of the drawing is a cross section through the transition construction shown in FIG. 1.

As illustrated in FIG. 2, the grip length of the screwed connection 7 is at least three times the thickness of the cover element 3 in the region of the screwed connection 7. In this case, the thickness of the cover element corresponds to the distance between the contact surface of the bolt head of the threaded bolt 7*a* in the recess of the cover element 3 and the contact surface of the cover element 3 on the retaining anchor 6. The grip length is the distance between the contact surface of the bolt head of the threaded bolt 7*a* on the cover element 3 and the contact surface of the tightening means 7*b* on the tightening means abutting piece 9.

The anchoring structure 4 has several anchor devices 10 that are arranged as set bolts on the spacers 8 of the several retaining anchors 6. As illustrated in FIG. 1, two anchor devices 10 each are mounted to one spacer 8 each at the same height perpendicular to the building joint in the direction to the building joint and in the opposite direction. In the built-in state the anchor devices 10 act like a shear connector.

Moreover, the transition construction 1 has an access duct 11 extending between the tightening means abutting piece 9 and the lower end of the building 2. Here, the access duct 11 is an oblong formwork tube surrounding the tightening means 7*b*. Thus, in the built-in or concreted state of the transition construction 1 access to the tightening means 7*b* from below is possible and so the screwed connection 7 can be adjusted during maintenance work.

As illustrated in FIGS. 1 and 2, the transition construction 1 has a draining element 12 that extends underneath and spaced apart from the cover element 3 and downward at an acute angle to the building joint. Here, the draining element 12 is arranged on the anchoring structure 4 and all the retaining anchors 6 penetrate it. Thus, the draining element 12 comprehensively surrounds all retaining anchors 6 to drain off water penetrating from above toward the building joint. In this embodiment the draining element 12 is a metal sheet that forms a drip edge downward towards the building joint and is chamfered upwards at its side facing away from the building joint. A small gap to avoid squeezes is to be provided between the upward chamfered end of the draining element 12 and the front face of the cover element 3 spaced apart from the building joint. In the regions in which the draining element 12 is penetrated by the retaining anchors 6 a water impermeable sealing is mounted between the draining element 12 and the retaining anchor 6. Said sealing is a rubber ring or silicone joint. Alternatively, the cover sheet as a whole can be lined with a flexible layer (e.g. cellular rubber), then the connection to the spacers 8 can be made by waterproof weld seams.

The transition construction 1 that can also be extended along the building joint is modularly built up using opposing fingerplates. After the transition construction 1 has been formed as an assembly preassembled in the manufacturing facility it only has to be concreted at the position of installation, as shown in FIG. 2, by means of the anchoring structure 4 at the building 2. In this example, the concreted portion of the anchoring structure 4 extends to the draining element 12.

LIST OF REFERENCE NUMBERS

1 transition construction
2 building
3 cover element
4 anchoring structure
5 carriageway
6 retaining anchor
7 screwed connection
7*a* threaded bolt
7*b* tightening means
8 spacer
9 tightening means abutting piece
10 anchoring element
11 access duct
12 draining element
13 insulation flange
14 corbel

The invention claimed is:

1. A transition construction for bridging a building joint between two component parts of a building with at least one cover element that at least partially covers the building joint and can be attached to a component part of the building via an anchoring structure, wherein the anchoring structure is configured such that the at least one cover element is punctually supported thereon, wherein the transition construction has a draining element that is arranged on the anchoring structure under and spaced apart from the cover element, at an acute angle to the cover element and downward towards the building joint.

2. The transition construction according to claim 1, wherein the anchoring structure has a plurality of support points at least one of which can be adapted or oriented in its position independently from the others.

3. The transition construction according to claim 1, wherein the cover element is detachably attached to the anchoring structure by means of at least one screwed connection and the anchoring structure is configured such that at least one screwed connection has a grip length corresponding to at least three times the thickness of the cover element in the region of the respective screwed connection.

4. The transition construction according to claim 1, wherein at least one screwed connection has a threaded bolt and at least one tightening means.

5. The transition construction according to claim 1, wherein the threaded bolt is part of a rule-consistent screw.

6. The transition construction according to claim 1, wherein at least one tightening means is formed as a nut, a bolt head, or a thread on the anchoring structure or the cover element.

7. The transition construction according to claim 1, wherein the anchoring structure has a tightening means abutting piece for a tightening means formed as a nut or a bolt head on a side facing away from the cover element.

8. The transition construction according to claim 1, wherein the anchoring structure has a spacer that ensures a defined distance between the cover element and the tightening means abutting piece.

9. The transition construction according to claim 1, wherein the spacer is configured tubular, preferably as a square tube.

10. The transition construction according to claim 1, wherein the anchoring structure is configured such that it can directly be attached to a reinforcement of a component part of the building.

11. The transition construction according to claim 1, wherein the anchoring structure has at least one anchor device for anchoring within a component part, wherein the anchor device is configured as a set bolt.

12. The transition construction according to claim 1, wherein the anchoring structure has at least one row of retaining anchors in parallel to the building joint and preferably a further row of retaining anchors behind it also in parallel to the building joint.

13. The transition construction according to claim 1, wherein the draining element is configured as a metal sheet that is chamfered downwards at its side facing the building joint such that this side forms a drip edge.

14. The transition construction according to claim 1, wherein the draining element configured as a metal sheet is chamfered upwards at its side facing away from the building joint and contacts a front face of the cover element.

15. The transition construction according to claim 1, wherein the draining element is flexibly attached to the anchoring structure.

16. The transition construction according to claim 1, wherein the draining element is flexibly supported on the building.

17. The transition construction according to claim 1, wherein the at least one retaining anchor of the anchoring structure passes through the draining element and in this region a flexible, waterproof seal is arranged.

18. The transition construction according to claim 1, wherein the transition construction has a sealing underneath the cover element, especially an elastomeric band.

19. The transition construction according to claim 1, wherein the cover element is configured as a fingerplate.

20. The transition construction according to claim 1, wherein the transition construction is modular and has a plurality of adjacent cover elements or draining elements that each are narrower than a carriageway of a car, wherein at least between adjacent draining elements a seal is arranged.

21. The transition construction according to claim 1, wherein the transition construction is configured as an assembly preassembled in a manufacturing facility in which the at least one cover element is detachably attached to at least one anchoring structure by means of at least one screwed connection, wherein the assembly as a whole can be attached to, especially concreted into the component part, preferably with the aid of a transport and/or mounting device via the anchoring structure.

22. A transition construction for bridging a building joint between two component parts of a building with at least one cover element that at least partially covers the building joint and can be attached to a component part of the building via an anchoring structure, wherein the anchoring structure is configured such that the at least one cover element is punctually supported thereon, wherein the transition construction has at least one access duct, wherein the access duct extends from the anchoring structure to one end of the building.

23. A transition construction for bridging a building joint between two component parts of a building with at least one cover element that at least partially covers the building joint and can be attached to a component part of the building via an anchoring structure, wherein the anchoring structure is configured such that the at least one cover element is punctually supported thereon, wherein it has two anchoring structures that are opposite with respect to the building joint it has to bridge and that have opposite cover elements, wherein the cover elements are configured as meshing fingerplates.

* * * * *